US012392227B2

(12) United States Patent
Roselier et al.

(10) Patent No.: US 12,392,227 B2
(45) Date of Patent: Aug. 19, 2025

(54) SYSTEM AND METHODOLOGY FOR UTILIZING ANCHORING ELEMENT WITH EXPANDABLE TUBULAR

(71) Applicant: Schlumberger Technology Corporation, Sugar Land, TX (US)

(72) Inventors: Samuel Roselier, Bruz (FR); Romain Neveu, Bruz (FR); Robin Laupie, Bruz (FR); Gwenael Tanguy, Bruz (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/293,043

(22) PCT Filed: Jul. 26, 2022

(86) PCT No.: PCT/US2022/038264
§ 371 (c)(1),
(2) Date: Jan. 29, 2024

(87) PCT Pub. No.: WO2023/009471
PCT Pub. Date: Feb. 2, 2023

(65) Prior Publication Data

US 2024/0337172 A1 Oct. 10, 2024

(30) Foreign Application Priority Data

Jul. 29, 2021 (EP) ..... 21306061

(51) Int. Cl.
*E21B 23/01* (2006.01)
*E21B 43/10* (2006.01)

(52) U.S. Cl.
CPC ..... *E21B 43/106* (2013.01); *E21B 23/01* (2013.01); *E21B 43/105* (2013.01)

(58) Field of Classification Search
CPC .. E21B 43/108; E21B 43/105; E21B 33/1292; E21B 33/1293; E21B 23/0411; E21B 43/103; E21B 23/01
See application file for complete search history.

(56) References Cited

U.S. PATENT DOCUMENTS 6,640,893 B1 11/2003 Rummel et al.
10,428,617 B2 10/2019 Radtke
(Continued)

FOREIGN PATENT DOCUMENTS

BR 112023026688 A2 3/2024
WO 2007021975 A1 2/2007
(Continued)

OTHER PUBLICATIONS

Dreesen, 1991, Analytical and Experimental Evaluation of Expanded Metal Packers for Well Completion Service, SPE 22858, presented at 66th annual Technical conference and exhibition of the society of petroleum engineers held in Dallas, TX, Oct. 6-9, 1991 (9 pages).
(Continued)

*Primary Examiner* — Tara Schimpf
*Assistant Examiner* — Lamia Quaim
(74) *Attorney, Agent, or Firm* — Jeffrey D. Frantz

(57) ABSTRACT

A technique facilitates improved anchoring of expandable well tools along a wellbore or other type of borehole. According to an embodiment, a well tool is sized for placement along a well string. The well tool comprises a tubing and an expandable tubular coupled to the tubing. The expandable tubular is plastically deformable in a radially outward direction when sufficient pressure is applied to an interior of the expandable tubular. The well tool also comprises at least one anchoring ring disposed circumferentially about the expandable tubular. The anchoring ring is constructed with at least one weak point which breaks during
(Continued)

expansion of the expandable tubular. Breakage at this weak point enables movement of the anchoring ring in a radially outward direction without elongation of the anchoring ring.

8 Claims, 7 Drawing Sheets

(56) References Cited

U.S. PATENT DOCUMENTS

| | | | | |
|---|---|---|---|---|
| 2004/0182583 | A1 | 9/2004 | Doane et al. | |
| 2007/0039161 | A1* | 2/2007 | Garcia | E21B 43/106 29/521 |
| 2008/0047704 | A1* | 2/2008 | Tom | E21B 43/106 166/118 |
| 2009/0065196 | A1 | 3/2009 | Holland | |
| 2012/0125619 | A1* | 5/2012 | Wood | E21B 33/1212 166/308.1 |
| 2018/0045016 | A1* | 2/2018 | Radtke | E21B 33/1285 |
| 2019/0383111 | A1* | 12/2019 | Patton | E21B 23/01 |
| 2020/0072018 | A1 | 3/2020 | Roselier | |
| 2020/0173248 | A1 | 6/2020 | Yee | |

FOREIGN PATENT DOCUMENTS

| | | | |
|---|---|---|---|
| WO | 2016055775 | A1 | 4/2016 |
| WO | 2020251940 | A1 | 12/2020 |

OTHER PUBLICATIONS

International Search and Written Opinion issued in PCT Application PCT/US2022/038264, dated Oct. 17, 2022 (14 pages).

* cited by examiner

SYSTEM AND METHODOLOGY FOR UTILIZING ANCHORING ELEMENT WITH EXPANDABLE TUBULAR

CROSS-REFERENCE TO RELATED APPLICATIONS

This application is a national stage entry under 35 U.S.C. 371 of International Application No. PCT/US2022/038264, filed Jul. 26, 2022 entitled "SYSTEM AND METHODOLOGY FOR UTILIZING ANCHORING ELEMENT WITH EXPANDABLE TUBULAR", which claims the benefit of European Patent Application No. 21306061.9, filed Jul. 29, 2021 entitled "SYSTEM AND METHODOLOGY FOR UTILIZING ANCHORING ELEMENT WITH EXPANDABLE TUBULAR," the disclosure of which is incorporated by reference in its entirety.

BACKGROUND

In many oil and gas well applications, a wellbore is drilled into the earth and through a reservoir of a desired fluid, e.g. oil and/or gas. The wellbore may subsequently be completed with appropriate completion equipment having expandable well tools, e.g. packers, which may be expanded and anchored at desired locations along the wellbore. For example, packers may be disposed along the completion equipment and expanded into sealing engagement with a surrounding wellbore wall, e.g. a casing wall surface, to facilitate production of the desired fluids from the reservoir. Depending on the application, the packers or other expandable well tools may be mounted along production tubing and selectively expanded into anchored engagement with the surrounding wellbore wall.

SUMMARY

In general, a system and methodology facilitate improved anchoring of expandable well tools along a wellbore or other type of borehole. According to an embodiment, a well tool is sized for placement along a well string. The well tool comprises a tubing and an expandable tubular, e.g. an expandable metal tubular, coupled to the tubing. The expandable tubular is plastically deformable in a radially outward direction when sufficient pressure is applied to an interior of the expandable tubular. The well tool also comprises at least one anchoring ring disposed circumferentially about the expandable tubular. The anchoring ring is constructed with at least one weak point which breaks during expansion of the expandable tubular. Breakage at this weak point enables movement of the anchoring ring in a radially outward direction without elongation of the anchoring ring.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
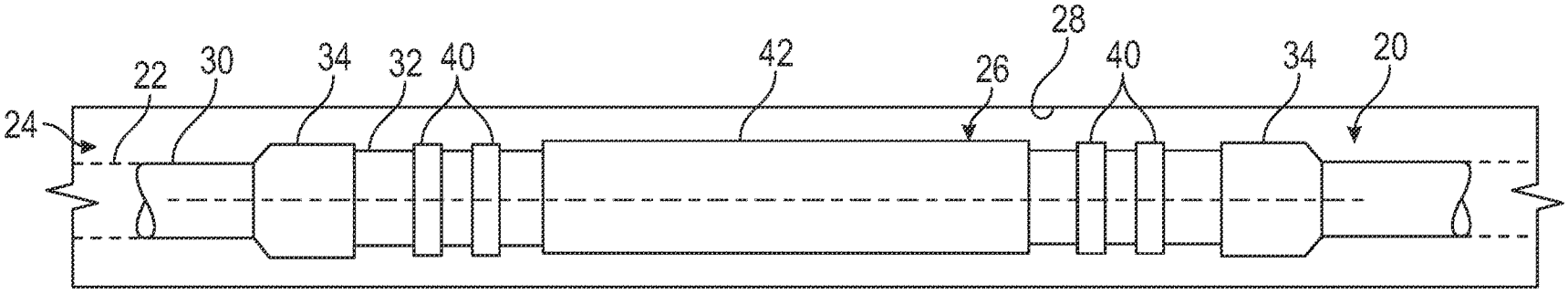
FIG. 1 is an illustration of an example of a well tool having an expandable tubular, e.g. an expandable metal tubular, with an anchoring element, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate improved anchoring of expandable well tools along a wellbore or other type of borehole. According to an embodiment, a well tool is sized for placement along a well string. The well tool comprises a tubing and an expandable tubular, e.g. an expandable metal tubular, coupled to the tubing. The expandable tubular is plastically deformable in a radially outward direction when sufficient pressure is applied to an interior of the expandable tubular. The well tool also comprises at least one anchoring element disposed circumferentially about the expandable tubular. The anchoring element is constructed with at least one weak point which breaks during expansion of the expandable metal tubular. Breakage at this weak point enables movement of the anchoring element in a radially outward direction without elongation of the anchoring element.

The construction and arrangement of each anchoring element enable the anchoring elements to be firmly held in position during the running-in-hole phase. Additionally, the construction limits the overpressure used for radially deforming the overall expandable tool. The anchoring element or elements can conform to the expandable tubular during expansion of the tool. Furthermore, each anchoring element is able to provide secure gripping with limited initial stress applied to the formation or tubular in which the anchoring element is expanded.

According to an embodiment, the well tool comprises an anchoring element, e.g. an anchoring ring, mounted onto an expandable tubular. The anchoring element may be placed between stop rings attached to the expandable tubular. The stop rings may be formed of metal or another suitable material and attached to an outer surface of the expandable tubular or within grooves formed about the circumference of the expandable tubular. In a variety of applications, the anchoring element is formed of a harder material, e.g. a harder steel, then the expandable tubular and it also may be surface treated or hardened. Additionally, the anchoring element may be formed with a triangular or trapezoidal transverse cross-sectional shape captured between the stop rings. The triangular/trapezoidal surfaces may be formed at angles of between 10° and 45° with respect to the base surface(s).

Prior to expansion of the expandable tubular and the anchoring element, e.g. during running-in-hole, the anchoring element is a single, one-piece element so that it cannot be moved or flushed. However, the anchoring element comprises a breakpoint which ruptures when radial expansion of the expandable tubular is initiated. In some embodiments, the anchoring element/ring may comprise a plurality of notches distributed circumferentially around the anchoring element/ring and which create reduced thickness areas in the anchoring element/ring. The notches provide the anchoring element/ring with increased flexibility and serve as hinges which allow the anchoring element/ring to conform during expansion of the expandable tubular. The anchoring element also may comprise a variety of gripping features to facilitate engagement and gripping of a surrounding wellbore wall, e.g. a surrounding casing surface. Furthermore, the anchoring element may comprise securing features, e.g. an elastomeric or polytetrafluoroethylene (PTFE) ring, a metallic ring, or other suitable features, which hold the anchoring element against the expandable tubular during expansion.

Figure 2:
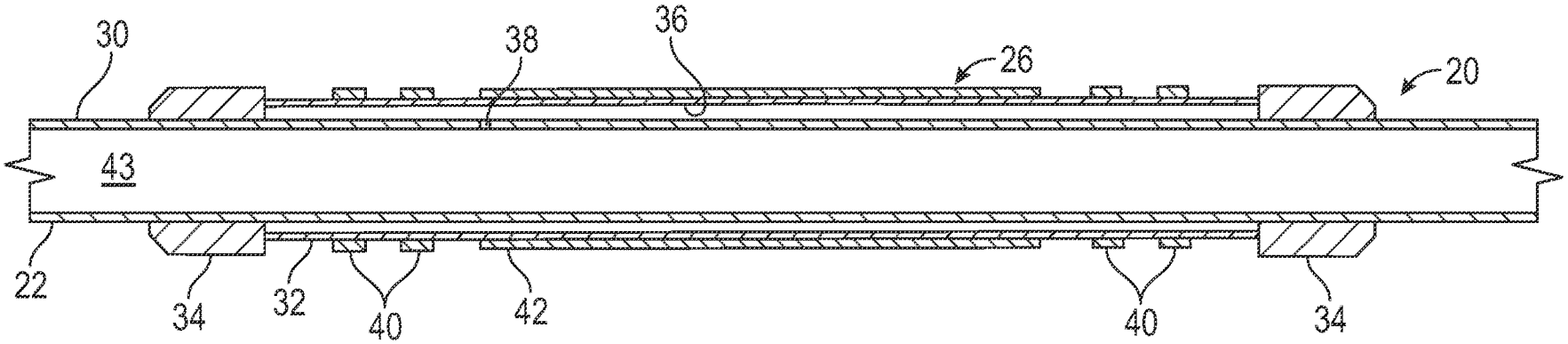
FIG. 2 is a cross-sectional view of the well tool illustrated in FIG. 1, according to an embodiment of the disclosure.

Referring generally to FIGS. 1 and 2, an example of a well tool 20 is illustrated as positioned along a well string 22 within a borehole 24, e.g. a wellbore. In this example, the well tool 20 is in the form of an expandable packer 26. However, the well tool 20 may comprise a variety of other types of expandable tools which are expanded into gripping engagement with a surrounding borehole wall/surface 28, such as an inner surface of casing. In the illustrated example, the well tool 20 comprises a tubing 30 which may form part of the overall production tubing through which well fluid is produced to a desired collection location.

The illustrated well tool 20 further comprises an expandable tubular 32 coupled to the tubing 30. The expandable tubular 32 may be made from a variety of materials, but in many downhole environments the expandable tubular 32 is in the form of an expandable metal tubular as described below. By way of example, the expandable metal tubular 32 may be coupled with tubing 30 via end connection rings 34. The expandable metal tubular 32 is plastically deformable in a radially outward direction when sufficient pressure is applied to an interior 36 of the expandable metal tubular to thus expand the tubular 32 in the radially outward direction. In some embodiments, expansion pressure may be directed to interior 36 via one or more expansion ports 38 formed radially through the tubing 30, as illustrated in FIG. 2. In the illustrated embodiment, the tubing 30 extends linearly through the expandable metal tubular 32 and may be concentrically positioned within tubular 32 as illustrated. However, other embodiments may be constructed which do not extend tubing 30 entirely through the expandable tubular 32.

Additionally, the well tool 20 comprises an anchoring element 40, e.g. a plurality of anchoring elements 40. In the specific example illustrated, the well tool 20 comprises four anchoring elements 40 although other numbers of anchoring elements 40 may be utilized. In a variety of applications, each anchoring element 40 is formed in the shape of a ring which is disposed circumferentially about the expandable metal tubular 32.

In the specific example illustrated, the well tool 20 is in the form of packer 26 which comprises a sealing element 42 mounted along an outer surface of the expandable metal tubular 32. The packer 26 may be actuated by directing a sufficiently high pressure fluid down through an interior 43 of tubing 30. This high pressure fluid flows through the one or more expansion ports 38 and into the interior 36 between tubing 30 and the surrounding expandable metal tubular 32. The pressure is sufficient to radially expand and plastically deform the expandable metal tubular 32 so as to drive the anchoring elements/rings 40 and the sealing element 42 into secure engagement with the surrounding borehole surface 28. It should be noted that other embodiments of the expandable well tool 20 may be constructed without use of sealing element 42.

Figure 3:
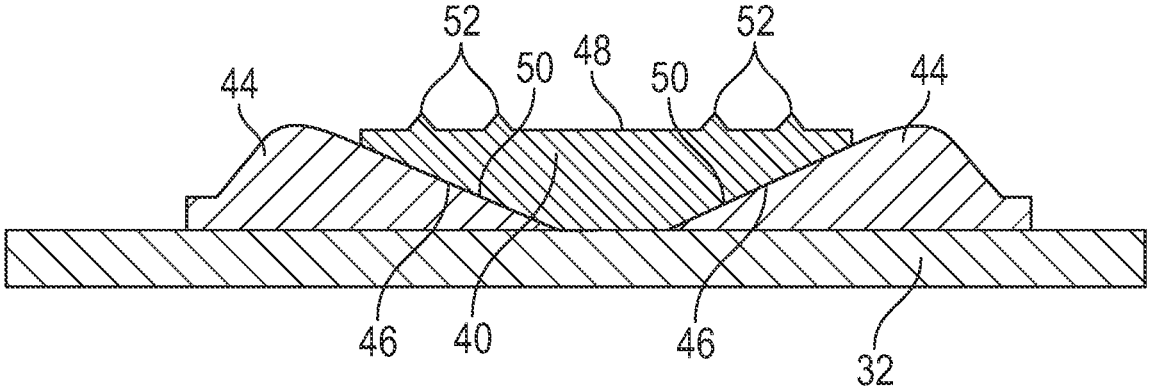
FIG. 3 is a cross-sectional illustration of an example of an anchoring element disposed about an expandable metal tubular, according to an embodiment of the disclosure.
Figure 4:
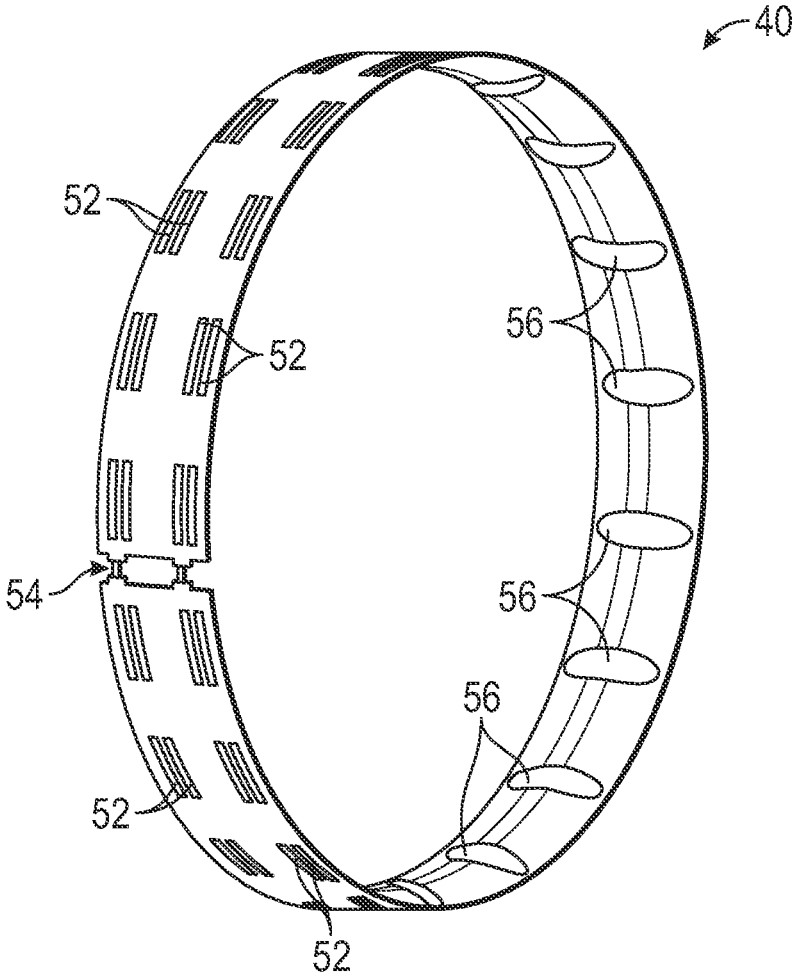
FIG. 4 is an orthogonal view of an example of an anchoring element having gripping features oriented to engage and grip a surrounding wall, according to an embodiment of the disclosure.

Referring generally to FIG. 3, a cross-sectional view of an example of anchoring ring 40 is illustrated as disposed circumferentially about the expandable metal tubular 32. In this embodiment, each anchoring ring 40 is positioned between stop rings 44 which are arranged circumferentially about the expandable metal tubular 32. The stop rings 44 may be welded to tubular 32, machined as part of tubular 32, or otherwise suitably attached to the expandable metal tubular 32. According to an example, the anchoring ring 40 may be generally triangular or trapezoidal in shape and may comprise angled surfaces 46 disposed at a suitable angle, e.g. 10° to 45°, with respect to an outer base surface 48. The stop rings 44 may have corresponding angular surfaces 50 positioned to secure the anchoring ring 40 therebetween. Additionally, the anchoring element/ring 40 may comprise a variety of gripping features 52, e.g. teeth, spikes, inserts, oriented to engage the surrounding wall 28 when the expandable metal tubular 32 is expanded.

Figure 5:
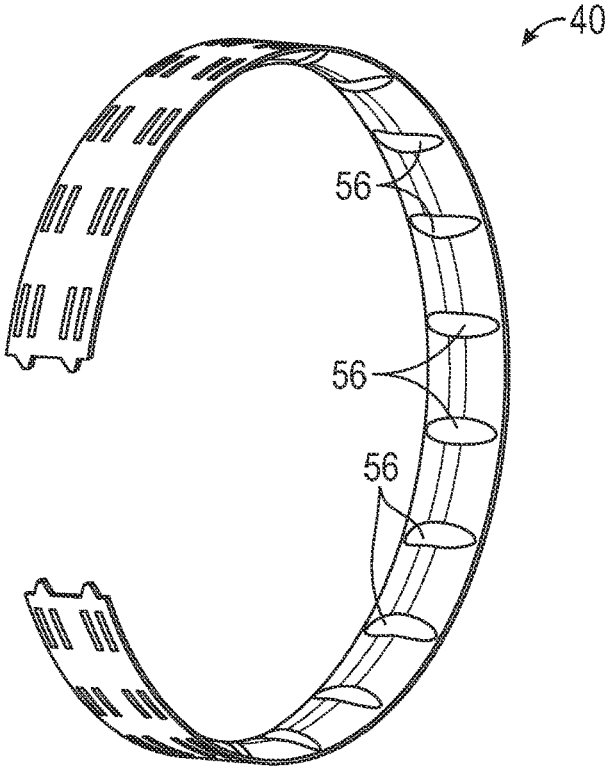
FIG. 5 is an orthogonal view of the anchoring element illustrated in FIG. 4 after expansion of the anchoring element and resultant breakage at a weak point of the anchoring element, according to an embodiment of the disclosure.
Figure 6:
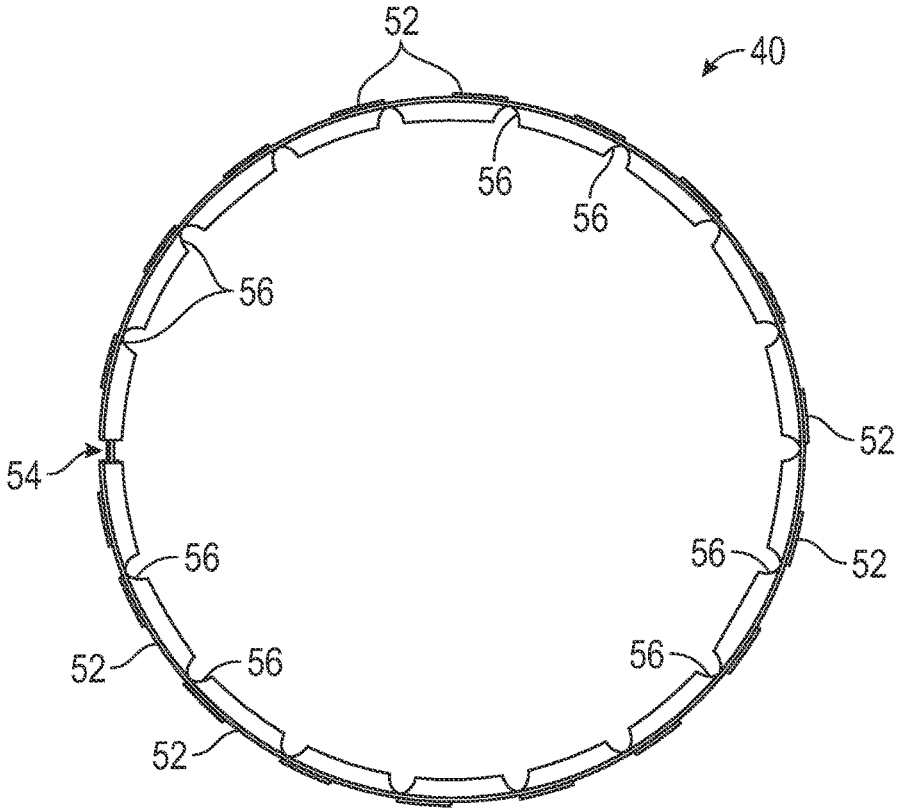
FIG. 6 is an illustration of an anchoring element having a plurality of notches arranged to provide increased flexibility in the anchoring element, according to an embodiment of the disclosure.
Figure 7:
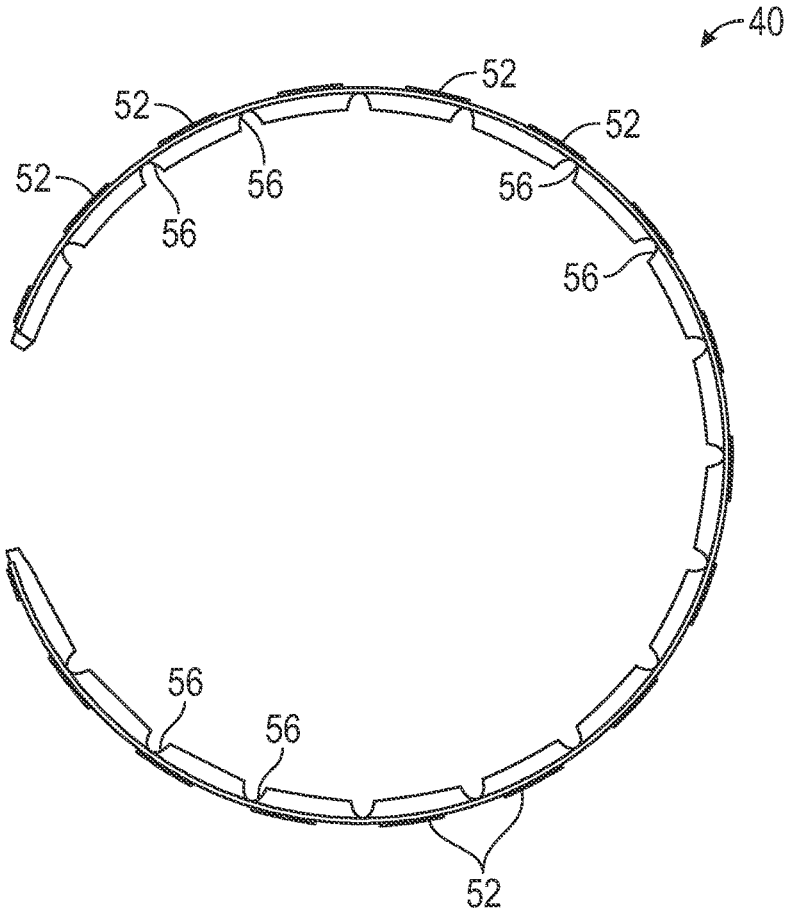
FIG. 7 is an illustration of the anchoring element of FIG. 6 after expansion of the anchoring element and resultant breakage at a weak point, according to an embodiment of the disclosure.

As further illustrated in FIGS. 4-7, each anchoring ring 40 may comprise a weak point 54 which breaks during expansion of the expandable metal tubular 32 (see FIGS. 5 and 7). By providing one or more weak points 54, the anchoring ring 40 is able to move radially outward during expansion of tubular 32 without being elongated. For example, the gripping features 52 may be moved radially outward into anchoring engagement with the surrounding wall 28 without having the anchoring ring 40 undergo elastic or plastic elongation. The weak point 54 may be formed via a variety of techniques, such as machining a thin section, connecting the ring ends via tack welding, or forming another suitable type of fracture/break point.

Figure 8:
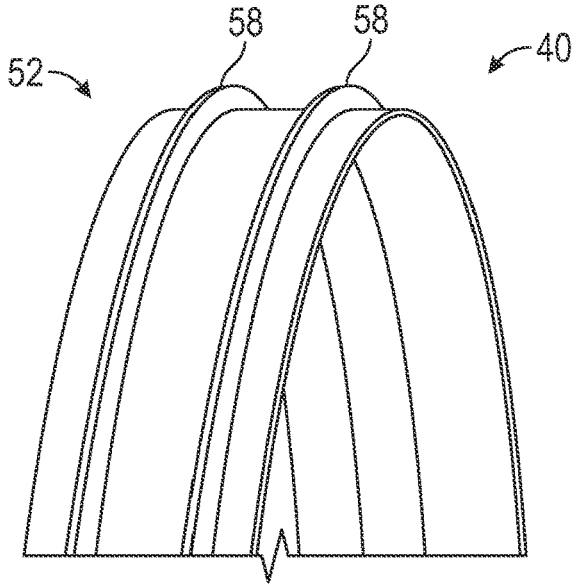
FIG. 8 is an illustration of another example of an anchoring element having a different type of gripping features, according to an embodiment of the disclosure.
Figure 9:
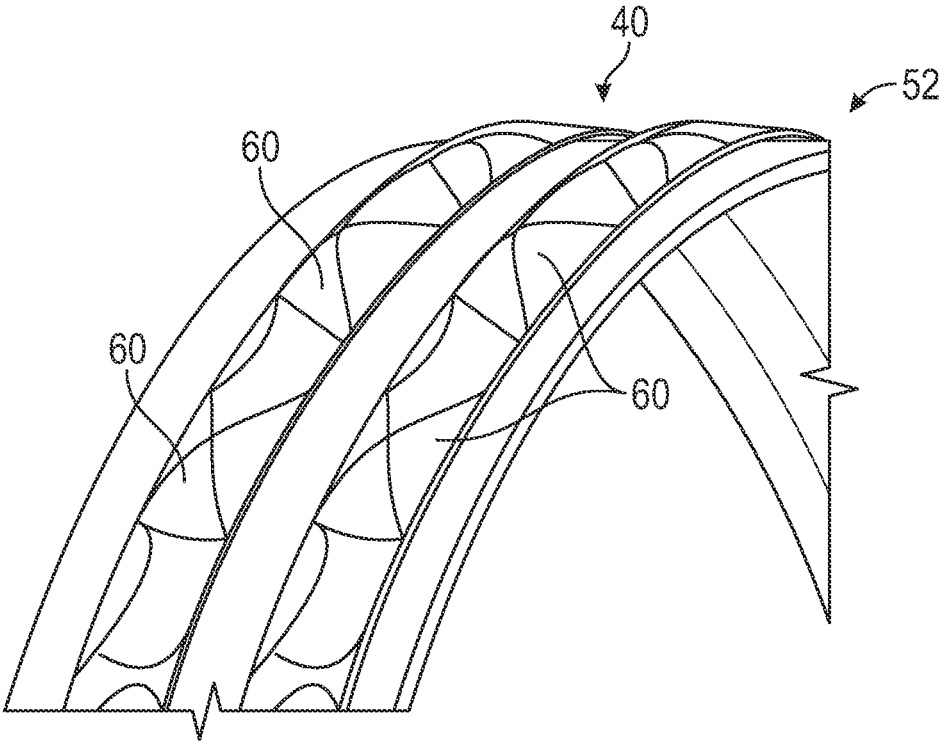
FIG. 9 is an illustration of another example of an anchoring element having another type of gripping features, according to an embodiment of the disclosure.

In some embodiments, each anchoring ring 40 may be formed with a plurality of notches 56 located along, for example, an interior of the anchoring ring 40. The notches 56 may be arranged circumferentially along the anchoring ring 40 to provide increased flexibility in the anchoring ring 40 relative to a ring without the notches. The flexibility afforded by notches 56 enables the anchoring ring 40 to adapt and conform to the shape and diameter of the expandable metal tubular 32 and the surrounding surface 28. This ensures an improved anchoring engagement of the gripping features 52 with the surrounding wall surface 28. It should be noted that gripping features 52 may comprise a variety of shapes and configurations, including circumferential ridges 58, as illustrated in FIG. 8, and rows of teeth 60, as illustrated in FIG. 9.

Figure 10:
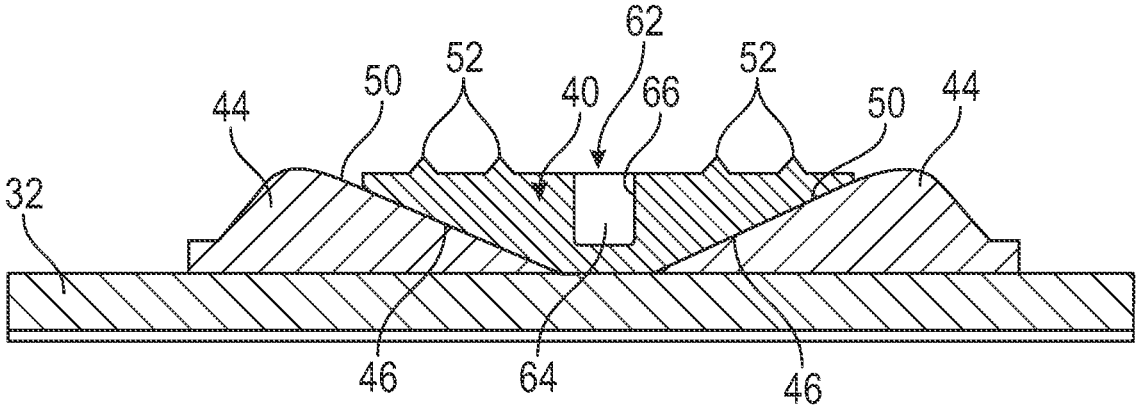
FIG. 10 is a cross-sectional illustration of an example of an anchoring element having a feature which helps hold the anchoring element against the expandable tubular during expansion, according to an embodiment of the disclosure.
Figure 11:
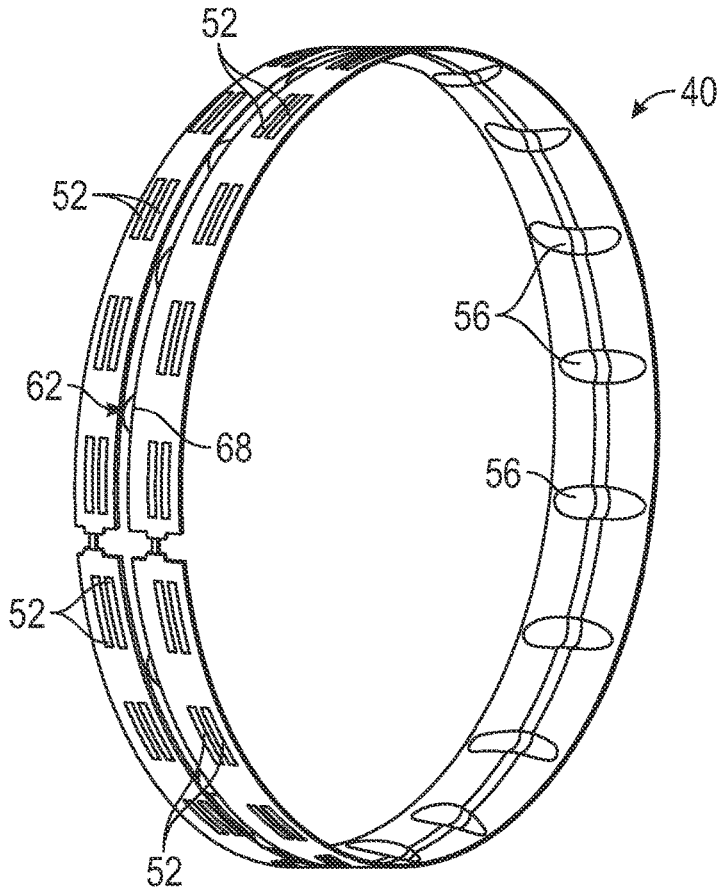
FIG. 11 is a cross-sectional illustration of another example of an anchoring element having a feature which helps hold the anchoring element against the expandable tubular during expansion.

Referring generally to FIGS. 10 and 11, another embodiment of anchoring element 40 is illustrated. In this example, the anchoring element 40 is in the form of a ring having a securing feature 62 which helps hold the anchoring ring 40 against the expandable metal tubular 32 during expansion. By way of example, the securing feature 62 may be in the form of a PTFE or elastomeric ring 64 received in a corresponding circumferential groove 66 formed along an exterior surface of the anchoring ring 40, as illustrated in FIG. 10. In other embodiments, the securing feature 62 may be in the form of a metallic C-ring 68, as illustrated in FIG. 11.

Figure 12:
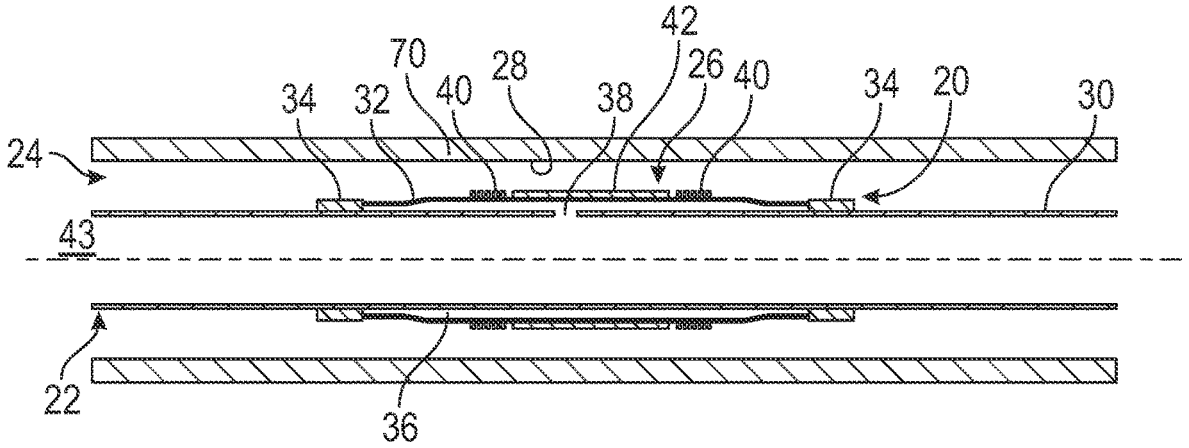
FIG. 12 is a cross-sectional illustration of a well tool in the form of a packer with an expandable tubular having a sealing element mounted thereon, according to an embodiment of the disclosure.
Figure 13:
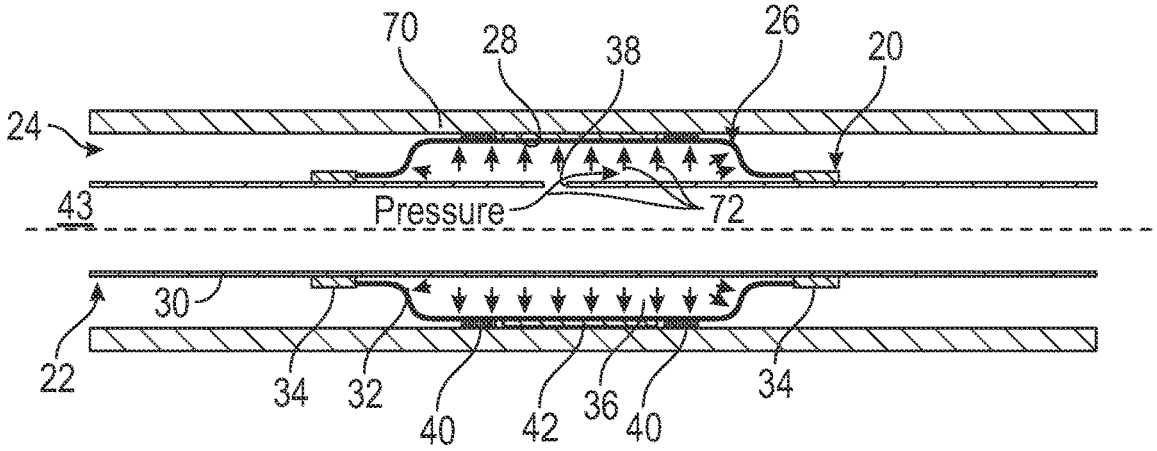
FIG. 13 is a cross-sectional illustration of the well tool illustrated in FIG. 12 after sufficient expansion of the expandable tubular to move the sealing element and the anchoring elements into engagement with a surrounding wellbore wall.

In FIG. 12, an example of well tool 20 is illustrated in the form of expandable packer 26 deployed downhole into wellbore 24 via well string 22. In this example, the expandable packer 26 is deployed to a desired downhole location within a surrounding casing 70 which establishes the surrounding wall/surface 28. While at the desired downhole location, fluid under pressure is directed downhole via, for example, interior 43 of tubing 30. The fluid under pressure flows through expansion port 38 and into interior 36, as indicated by arrows 72, so as to radially expand the expandable metal tubular 32, as illustrated in FIG. 13. By applying sufficient pressure, the expandable metal tubular 32 is plastically deformed in a radially outward direction. Consequently, the anchoring rings 40, as well as sealing element 42, are moved into anchoring and sealing engagement, respectively, with the surrounding surface 28.

Figure 14:
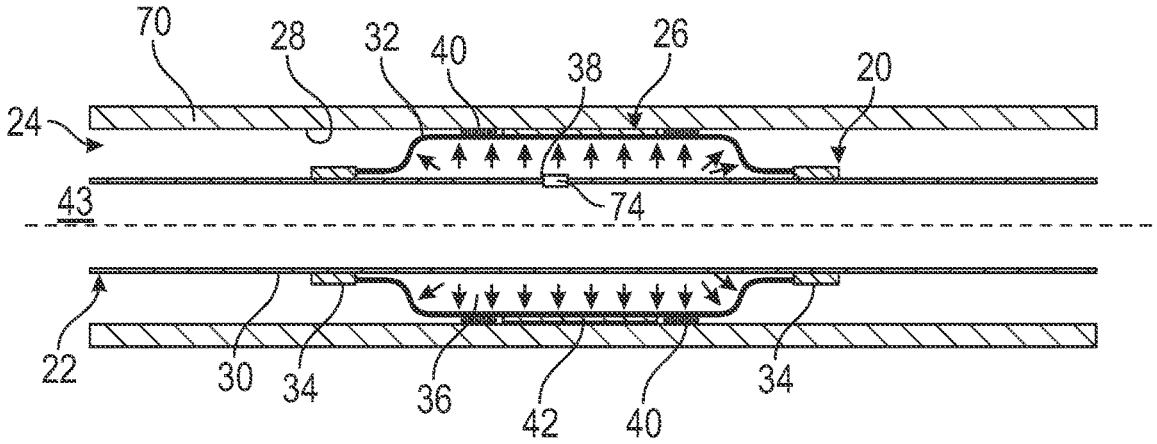
FIG. 14 is a cross-sectional illustration of another example of the well tool in the form of a packer with an expandable tubular having a sealing element mounted thereon, according to an embodiment of the disclosure.

Anchoring performance may be increased in some applications by further increasing pressure within interior 36. In some embodiments, the increased pressure within interior 36 may be trapped via a valve 74, as illustrated in FIG. 14. The valve 74 ensures that the relatively high pressure remains in interior 36 so as to maintain substantial force driving anchoring rings 40 into gripping engagement with the surrounding surface 28. By way of example, the valve 74 may be a one-way check valve or other suitable valve placed in expansion port 38 or along the flow path through expansion port 38.

Figure 15:
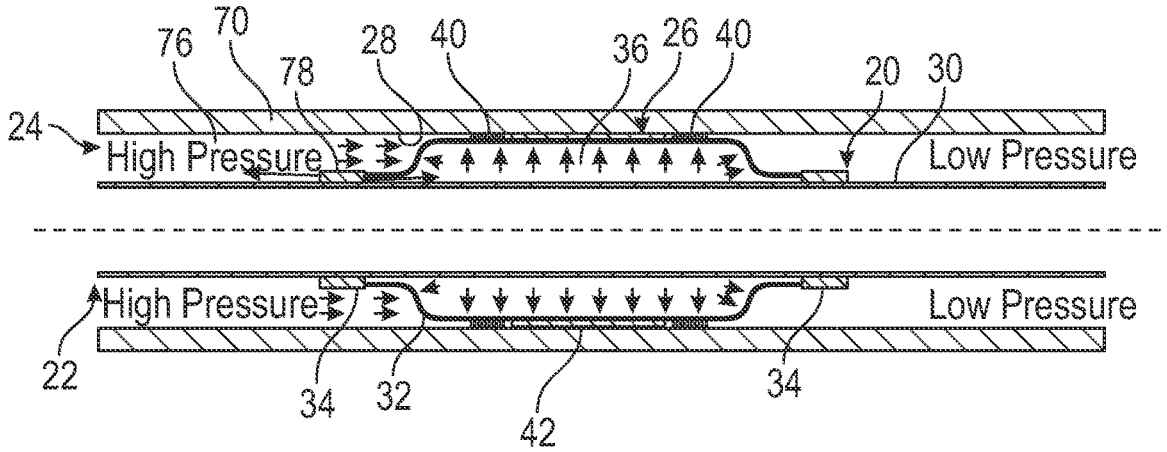
FIG. 15 is a cross-sectional illustration of another example of the well tool in the form of a packer with an expandable tubular having a sealing element mounted thereon, according to an embodiment of the disclosure.

In some embodiments, the high-pressure fluid may be directed into interior 36 from an annulus 76 surrounding tubing 30, as illustrated in FIG. 15. A valve system 78 may be positioned on one side or both sides of the expandable packer 26 to compensate annulus pressure. As illustrated, for example, the valve system 78 may be positioned on a high pressure side of expandable packer 26 to allow high pressure on that side of the packer 26 to flow from the annulus 76 to the interior 36. The high pressure fluid is able to energize interior 36 and thus help increase the anchoring performance of the anchoring element 40 on the opposite side of sealing element 42. It should be noted the anchoring performance of the anchoring element 40 on the same side of sealing element 42 may not be increased as much due to the same high pressure being on the inside and outside of the expandable metal tubular 32. Effectively, this type of system is self energized with annulus pressure.

Depending on the parameters of a given operation and the environment in which such operation is conducted, the components of well tool 20 may be made from a variety of materials and in a variety of configurations. For example, a single anchoring element 40 or a plurality of anchoring elements 40 may be used to secure the well tool 20 with a surrounding wall. Additionally, the expandable tubular 32 may be in the form of an expandable metal tubular formed in a variety of sizes and with different types of metal materials or other materials which are able to plastically deform when exposed to sufficient internal pressure. The expandable metal tubular 32 may be combined with sealing element 42 to form expandable packer 26 which may be used to seal off sections of wellbore 24. However, the expandable tubular 32 may be combined with a variety of anchoring elements 40 in other types of expandable anchoring tools.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a well tool sized for placement along a well string, the well tool comprising:

a tubing;

an expandable metal tubular coupled to the tubing with connection rings, the expandable metal tubular being plastically deformable in a radially outward direction when sufficient pressure is applied to an interior of the expandable metal tubular through one or more ports formed radially through the tubing to thus expand the expandable metal tubular;

the tubing extends linearly through the expandable metal tubular such that the expandable metal tubular is positioned concentrically about the tubing; and an anchoring ring disposed circumferentially about the expandable metal tubular, the anchoring ring having a weak point which breaks during expansion of the expandable metal tubular such that the anchoring ring is able to move radially outward without being elongated, wherein the anchoring ring comprises a plurality of notches located along an interior of the anchoring ring, such that a radial thickness of the anchoring ring is greater between adjacent notches than at each notch, and the anchoring ring remains intact at the plurality of notches following expansion of the expandable metal tubular into anchoring engagement with a surrounding surface.

2. The system as recited in claim 1, wherein the anchoring ring comprises a plurality of anchoring rings disposed circumferentially about the expandable metal tubular.

3. The system as recited in claim 1, wherein the anchoring ring comprises gripping features oriented to engage and grip a surrounding wall once the expandable metal tubular has been sufficiently expanded.

4. The system as recited in claim 1, wherein the anchoring ring has a triangular portion captured between stop rings secured to the expandable metal tubular and arranged circumferentially about the expandable metal tubular.

5. The system as recited in claim 1, wherein the anchoring ring is formed from a harder material than the expandable metal tubular.

6. The system as recited in claim 1, wherein the well tool is an expandable packer comprising a sealing element mounted on an outer surface of the expandable metal tubular.

7. The system as recited in claim 6, wherein a valve is provided on a side of the expandable packer, said valve is configured to compensate an annulus pressure.

8. The system as recited in claim 7, wherein an annulus differential pressure energizes an anchoring element opposite the annulus pressure.

* * * * *